US007246509B2

(12) United States Patent
Hardee et al.

(10) Patent No.: US 7,246,509 B2
(45) Date of Patent: Jul. 24, 2007

(54) KNITTED GLOVE WITH CONTROLLED STITCH STRETCH CAPABILITY

(75) Inventors: Fred Hardee, Asheville, NC (US); Greg Plemmons, Tinton Falls, NJ (US); Eric Thompson, Clemson, SC (US); San Allen, El Paso, TX (US); Dave Narasimhan, Flemington, NJ (US)

(73) Assignee: Ansell Healthcare Products LLC, Red Bank, NJ (US)

( * ) Notice: Subject to any disclaimer, the term of this patent is extended or adjusted under 35 U.S.C. 154(b) by 0 days.

(21) Appl. No.: 11/612,729

(22) Filed: Dec. 19, 2006

(65) Prior Publication Data

US 2007/0084251 A1 Apr. 19, 2007

Related U.S. Application Data

(63) Continuation of application No. 11/181,064, filed on Jul. 13, 2005, which is a continuation-in-part of application No. 10/892,763, filed on Jul. 16, 2004, now Pat. No. 6,962,064.

(51) Int. Cl.
*D04B 7/34* (2006.01)

(52) U.S. Cl. ..... 66/174

(58) Field of Classification Search ..... 66/169 R, 66/170, 171, 174, 202; 2/158–160, 161.1, 2/161.2, 162, 163
See application file for complete search history.

(56) References Cited

U.S. PATENT DOCUMENTS 5,187,815 A * 2/1993 Stern et al. ..... 2/16
5,231,700 A * 8/1993 Cutshall ..... 2/161.7
5,284,032 A 2/1994 Shima
5,511,394 A * 4/1996 Shima ..... 66/232
5,547,733 A 8/1996 Rock et al.
5,564,127 A * 10/1996 Manne ..... 2/161.7
5,965,223 A 10/1999 Andrews et al.
6,044,493 A * 4/2000 Post ..... 2/167
6,155,084 A * 12/2000 Andrews et al. ..... 66/174
6,182,477 B1 * 2/2001 Shibata et al. ..... 66/232

(Continued)

FOREIGN PATENT DOCUMENTS

JP 57-106753 7/1982

(Continued)

*Primary Examiner*—Danny Worrell
(74) *Attorney, Agent, or Firm*—Diehl Servilla LLC; Glen M. Diehl; Karen M. Whitney

(57) ABSTRACT

A knitted glove made by creating each of the sections of the glove using a separate knitting course on a flat knitting machine providing variable stitch dimensions. Each of these sections provides its own designed stretch characteristics so that the glove fits tightly, yet provides flexibility and ease of movement. The variable stitch dimension is achieved by 1) varying the depth of penetration of a knitting needle into a fabric being knitted by a computer program, 2) adjusting the tension of yarn between a pinch roller and a knitting head by a mechanism controlled by a computer, and 3) casting off or picking up additional stitches in a course. The glove includes a plurality of finger components made from at least ten separately knitted sections, two palm components, each of which is made from at least two separately knitted sections, and a wrist component made from at least one knitted section.

17 Claims, 5 Drawing Sheets

U.S. PATENT DOCUMENTS

| | | | | |
|---|---|---|---|---|
| 6,550,285 | B2 | 4/2003 | Nishitani | |
| 6,581,366 | B1 * | 6/2003 | Andrews | 57/225 |
| 6,766,635 | B2 * | 7/2004 | Andrews | 57/246 |
| 6,782,720 | B2 * | 8/2004 | Vero et al. | 66/171 |
| 6,782,721 | B1 | 8/2004 | Vero et al. | |
| 6,790,122 | B2 * | 9/2004 | Mitchell et al. | 450/66 |
| 6,823,699 | B1 * | 11/2004 | Vero et al. | 66/171 |
| 6,945,080 | B2 | 9/2005 | Maeda et al. | |
| 6,962,064 | B1 * | 11/2005 | Hardee et al. | 66/174 |
| 6,962,864 | B1 | 11/2005 | Jeng et al. | |
| 2004/0055070 | A1 | 3/2004 | Maeda et al. | |

FOREIGN PATENT DOCUMENTS

| | | |
|---|---|---|
| JP | 11-200123 | 7/1999 |
| JP | 2002-201515 | 7/2002 |
| JP | 2005-038116 | 2/2005 |

* cited by examiner

PRIOR ART

KNITTED GLOVE WITH CONTROLLED STITCH STRETCH CAPABILITY

CROSS-REFERENCE TO RELATED APPLICATIONS

This application claims continuation priority to U.S. patent application Ser. No. 11/181,064 filed on Jul. 13, 2005, which claims continuation-in-part priority to Ser.No. 10/892,763 now U.S. Pat. No. 6,962,064 filed on Jul. 16, 2004, the disclosures of which are hereby incorporated by reference in their entireties.

TECHNICAL FIELD

The present invention relates to knitted gloves. More specifically; the invention relates to knitted gloves, knitted glove liners, and methods of making them.

BACKGROUND

Knitted gloves are commonly used in handling and light assembly conditions. Knitted gloves used for these purposes are currently made using flat knitting machines that use a number of needles in the form of a needle array and a single yarn to knit the gloves using eight basic components to comprise the glove. These eight components include one component for each of the five fingers, two components for the palm including a upper section and a lower section, and one component for the wrist area. All of these sections are cylinders or conical sections that join to each other fashioning the general anatomical shape of a hand. Conventional knitting processes use a knitting machine to knit each of these areas in a particular sequence, generally one finger at a time, beginning with the pinky finger and continuing on through the ring finger and middle finger to the forefinger. After each finger is knitted using only selected needles in the needle array, the knitting process for this finger is stopped, and yarn is cut and bound. The knitted finger is held by holders, weighted down by sinkers. The next finger is knit sequentially one at a time using a different set of needles in the needle array. When all four fingers are knitted in this fashion, the knitting machine then knits the upper section of the palm, picking stitches from each of the previously knit four fingers. The method of knitting individual fingers and picking stitches to knit the upper palm section with crotches that are well-fitted is discussed in U.S. Pat. App. Pub. No. 2004/0055070 by Maeda et al. After knitting an appropriate length of upper palm, the thumb portion is initiated, using a separate set of needles in the needle array, and the lower section of the palm is knit using all of the needles in the needle array. Finally, the knitting machine knits the wrist component to the desired length.

The knitting stitches used at the fingertips are generally tighter than the stitches used elsewhere in the glove to improve the strength of the glove in this area, where more pressure is likely to be applied. Depending on the size of the needles used and the denier of the yarn to knit the gloves, a certain number of courses are used to create each of the eight components of the glove. The finer the gauge of needle used, the higher the number of courses for each component to create the same size of a finished glove. Changing needles or the denier of a yarn is extremely difficult in a continuous process and generally a continuous yarn of pre-selected denier and a corresponding needle size are commercially used. While this standardization in needle size and number of courses permits the manufacturing of a glove or liner with a standard shape, that shape does not accommodate variations in size and shape of individual fingers and hands.

U.S. Pat. No. 6,155,084 to Andrews et al. discloses protective articles made of a composite fabric. These protective articles provide an unprecedented level of safety and comfort and are made of two or more dissimilar yarns including thermoplastics, elastomers, or metals, each having dissimilar mechanical properties and characteristics. Thus, the protective article does not use a heavy weight fabric in regions of the article where exceptional protection is not critical and avoids the accompanying loss of tactile sensitivity. The protective article uses dissimilar fibers at selected protective fabric locations and does not aim to conform to the anatomical shape of a hand using a single yarn.

U.S. Pat. No. 6,550,285 to Nishitani discloses a yarn feeding apparatus. This apparatus minimizes fluctuation in tension of a knitting yarn, and an accurate length of the knitting yarn is fed, even if the amount of demand for the knitting yarn is suddenly changed. A knitting yarn is interposed between a main roller and a driven roller with yarn storage having a buffer rod, the inclination of which controls the storage. An angle sensor detects this angular inclination and uses a PID algorithm to predict the amount of knitting yarn demanded. The PID algorithm controls a servo-motor that drives the driven roller, such that the tip portion of the buffer rod is brought to its original position at the start of knitting. This device minimizes the fluctuations in knitting yarn tension due to sudden demand and is not programmed to alter the knitting yarn tension to adjust stitch dimensions.

U.S. Pat. No. 5,284,032 to Shima discloses a stitch control mechanism for a flat knitting machine. A stitch control mechanism is applicable for a flat knitting machine and controls loop size in a knit fabric. A spiral cam plate is attached to one surface of a stitch control cam. The spiral cam plate is held between a pair of cam rollers, and the pair of cam rollers is supported on a guide plate. The stitch cam has a portion slidably fitted in a guide slot formed in a base plate. The stitch dimension or loop size is controlled by the stitch control cam and can be changed by a computer program. This patent discloses the hardware necessary for stitch dimension control and does not disclose a knitted glove or liner with anatomic features providing improved fit.

Standard shaped gloves or liners created by the current processes bring with them several disadvantages. First, the fit across finger knuckles and the center of the palm is tight, reducing glove or liner flexibility and ultimately reducing hand dexterity. Second, the standard gloves or liners bag or gap in areas where the hand normally tapers, e.g., like the lower palm and wrist area. This bagginess or gapping results in excess fabric, which can bunch and catch on protruding objects. Additionally, excess fabric at the lower palm created by the standard glove or liner shape causes an irregular foam line on those liners that are dipped in latex. Finally, the excess fabric at the lower palm of the standard glove or liner causes a high scrap rate in printing information on the gloves or liners.

In an attempt to solve these problems, knit gloves or liners can be made of a larger than standard size to shrink them to achieve a better fit. These larger gloves are reduced in size by tumbling them in heat or using a laundry process. These processes as used on the larger gloves, however, may produce gloves that have improved fit across the knuckles, but do not address the excess fabric in areas where the hand normally tapers, like the lower palm and wrist, since the shrinkage is uniform across the glove. Additionally, tumbling or a laundry process would require an additional manufacturing step as well as additional labor, both of which would increase the cost of the finished product. A standard tumbling process, using constant heat and time, would also fail to create the desired gloves and liners because of differences in heat sensitivity of the fibers selected to knit the various gloves and liners in a manufacturing operation. Further, these types of post-knitting processes would require additional development and manufacturing time to determine appropriate time and heat combinations to optimize the production of a particular glove or liner.

A glove that could be made to fit the contours of a human hand better to improve grip and that would not require post-knitting processing would, therefore, be an important improvement in the art. The present invention seeks to provide such a glove. This and other objects and advantages, as well as additional inventive features, will be provided by the detailed description provided herein.

SUMMARY

The present invention is directed towards knitted gloves and liners and a method of making these knitted gloves and liners using a continuous single yarn and array of knitting needles matching the yarn denier. The invention relates to the fit of knitted gloves or liners on a human hand. Specifically, the stitch dimension and the number of courses used to knit each of the standard eight major glove components and their sections of the glove are altered to provide a glove geometry, which is anatomically matched to a human hand, providing increased stretch capability in areas that flex during movement. This increased stretch capability provides the wearer with a tight-fitting glove, which still provides a comfortable glove feel and an easy movement capability. These geometric alterations help conform the glove or liner to fit better human hands. The alterations permit manufacturing of gloves or liners with nearly perfect fit to the hand because of their tapered fingertips, expanded knuckles, tapered palm areas and expanded cuff width.

The stitch dimension in each course that is knitted determines the level of stretch available at that knitted course location. The number of courses determines the overall stretch of the fabric at a particular location in the glove. The stitch dimension has three discrete components, which may be changed individually or changed in combination under computer control of the flat knitting machine. The first embodiment of the stitch dimension comprises stitch setup specification, which increases or decreases the depth of penetration of the knitting needle into the knitted fabric. Increasing the depth of penetration of the knitted needle brings in a larger length of knitting yarn in the knitted loop, and the stitch can expand more than stitches knitted with smaller depth of penetration. If a full course is knitted with a deeper depth of penetration, that course can stretch more readily. If subsequent courses are knitted with the same depth of penetration, the fabric knitted has a uniform stretch feel. However, if the depth of penetration of the knitting needle is progressively decreased, the fabric knitted has a stretch feel that decreases progressively. Therefore, the depth of penetration of the knitting needle provides a knitted fabric section of a glove that has 'designed in' stretch capability.

In a second embodiment of the stitch dimension, the tension in the yarn that is being knitted is increased or decreased under computer control. The yarn from a spool is clamped between a pair of pinch rollers, one of which may optionally be a computer-controlled feeding roller. Due to the pinching action, the tension in the yarn in the knitting head is not transmitted to the yarn spool. The computer controls the tension in the yarn in the segment between the pinch roller and the knitting head by means of a computer-controlled tension adjustment mechanism. This adjustment mechanism may comprise a spiral spring carrying an arm through which the yarn passes. A spiral spring is attached to the arm, and the other end of the spiral spring is attached to a stepper motor. The computer rotates the stepper motor shaft, thereby increasing or decreasing the tension in the yarn in the segment between the pinch roller and the knitting head. The tension in the knit stitch limits its stretch capability. A full course stitched with increased tension has reduced stretch capability of that course. Accordingly, a fabric knitted with a number of courses with increased tension exhibits reduced stretch capability.

In a third embodiment of stitch dimension, a stitch can be missed in knitting a course. This decreases the overall stretch capability of the course. On the other hand, an additional stitch can be picked from the stitch to increase the overall length of a course to provide increased stretch capability.

The glove has eight components, four of which define the four fingers, two of which define the palm, one defining the thumb and one defining the wrist. Each of these components is divided into one or more sections. In one embodiment, one or more of the finger components of the glove is divided into two or more sections. The upper and lower palm components are divided into two or more sections, and the wrist component is made up of one or more sections, where each section is knitted using a different stitch setup and each of the stitch setups is continued for a number of courses according to the desired geometrical shape of the glove. In another embodiment, each finger component of the glove is divided into three sections, and the upper and lower palm of the glove is divided into three sections, where each section is knitted using a different stitch setup and each of the stitch setups is continued for a number of courses according to the desired geometrical shape of the glove. In another embodiment, the upper and lower palm of the glove is divided into four sections, where each section is knitted using a different stitch setup and each of the stitch setups is continued for a number of courses.

The course knitted with a different stitch dimension essentially provides more yarn or less yarn at a given glove location, thereby providing enhanced or reduced stretch capability. The sections, which are required to have less stretch and, therefore, have a tight feel, are made with stitches that incorporate a smaller length of yarn and/or a high tension or have one or more stitches less than the adjacent courses. Conversely, when a section requires increased stretch capability, the stitches are made with increased yarn length and/or with reduced tension or may have one or more stitches picked up in the courses compared to adjacent courses.

The invention also includes a method for manufacturing gloves and liners using variable stitch dimensions and numbers of courses in each of the sections within each of the eight major glove components to create a better fitting glove.

DETAILED DESCRIPTION

Figure 1:
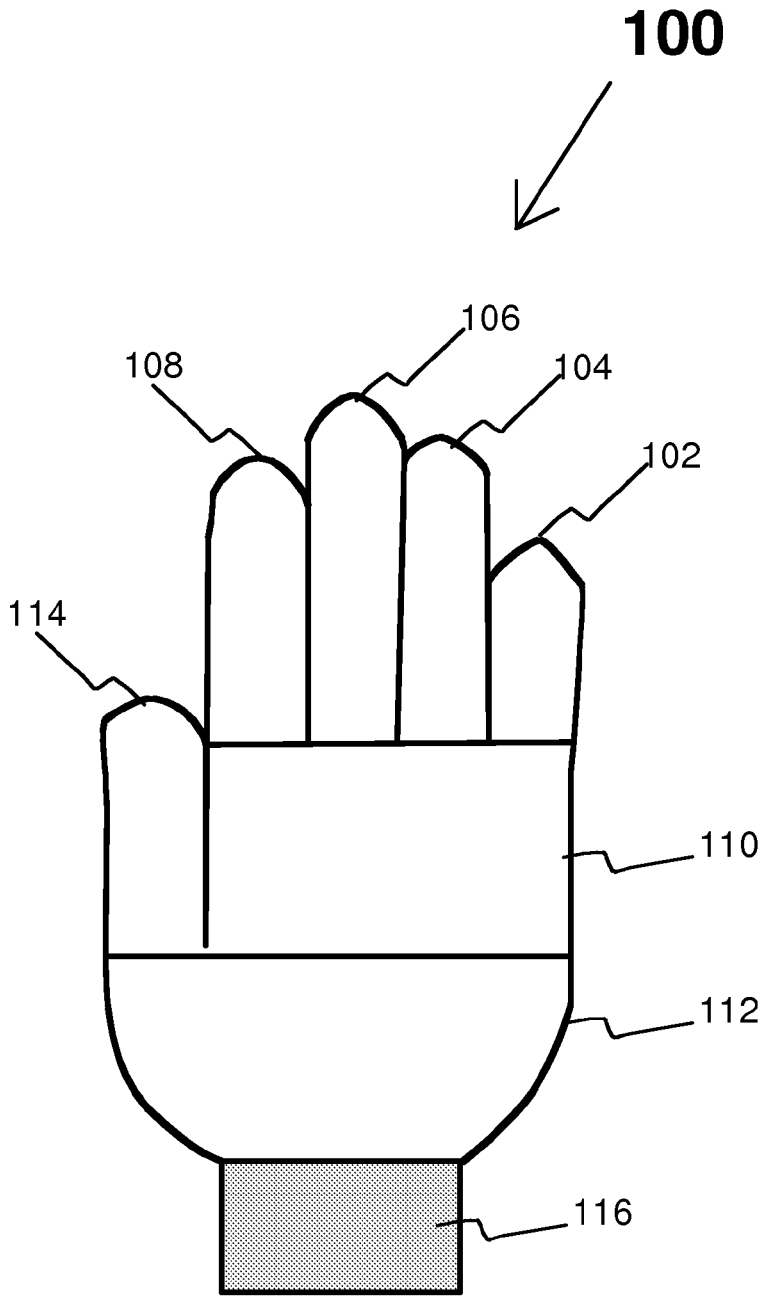
FIG. 1 shows a glove knitted using a standard number of courses and needles to create the standard eight components.

The prior art, as shown in FIG. 1, is a glove 100, having eight major glove components. These components include a pinky finger component 102, a ring finger component 104, a middle finger component 106, a forefinger component 108, an upper palm component 110, a lower palm component 112, a thumb component 114, and a wrist component 116. As can be seen in FIG. 1, the shapes of the glove 100 fingers do not taper, nor does the wrist component 116 taper to prevent bagginess and gapping at the wrist. Additionally, the fingers of the glove 100 do not taper near the fingertips.

Existing flat knitting machines can be programmed to accommodate a large number of changes in stitch dimensions using stitch setup and to alter the physical dimensions used in a standard eight component glove 100 of FIG. 1. Stitch setup can be used to "customize" gloves and liners manufactured in sizes 6, 7, 8, 9, and 10. They also can be used to develop specifications for finger length and width, palm length and width, and overall glove or liner length and width.

Figure 2:
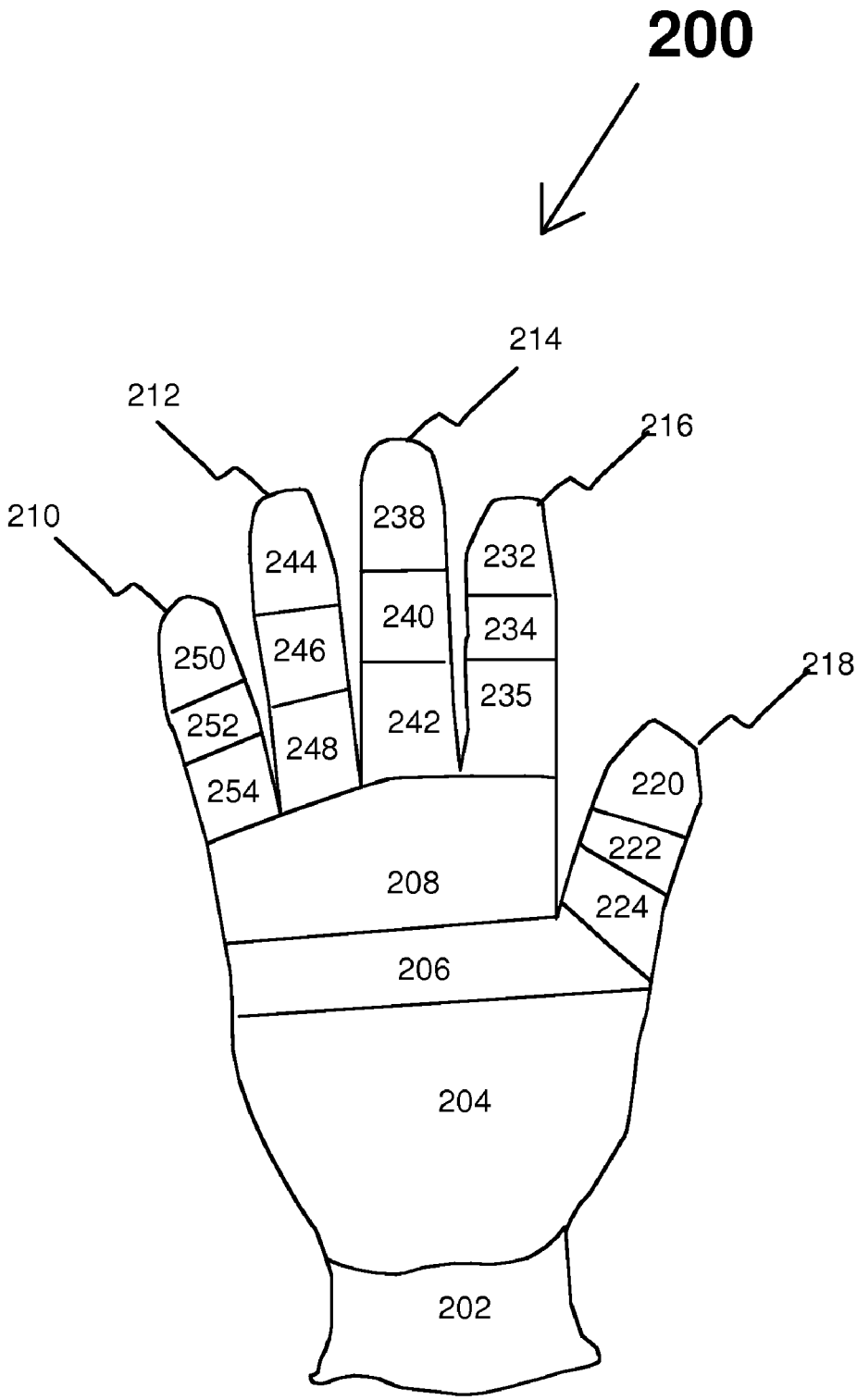
FIG. 2 shows the glove of the present invention.

FIG. 2 shows the glove 200 of the present invention. This glove 200 includes nineteen total sections of the glove, including three sections for each of the finger components 210, 212, 214, and 216 and thumb 218 of the glove, three palm sections 204, 206, and 208 and one wrist section 202. Each of the fingers 210, 212, 214, 216 and 218 is knit according to three separate instructions for the knitting machine to create these three distinct areas designed to conform to the shape of fingers. These three sections are shown in FIG. 2 as sections 250, 252, and 254 for the pinky finger 210; sections 244, 246, and 248 for the ring finger 212; sections 238, 240 and 242 for the middle finger 214; sections 232, 234, and 235 for the forefinger 216; and sections 220, 222, and 224 for the thumb 218.

The glove 200 of this invention can be knit on a knitting machine and requires programming of the machine for each of the nineteen sections. For example, the glove 200 can be made according to the specifications provided in Table 1. Each of the components is indicated, and the sections that match FIG. 2 are shown. Note that the courses begin with 1 for each component and continue through the sections. The stitch setup here shows a number, which indicates how deep the knitting needle penetrates. A lower number indicates less needle penetration, while a larger number indicates that the needle penetrates deeper. For example, in component 1, which is the pinky finger, the first course has a knitting needle penetration depth of 37 in course 1 and increases gradually in a linear fashion to a knitting needle penetration depth of 39 at course 39. This means that course 1 is tighter to stretch than course 22, and the pinky finger is draped the glove with the finger edge tight against the glove. The second section component 1 continues seamlessly with the same stitch setup of 39, maintaining the depth of penetration of the knitting needle.

TABLE 1

| COMPONENT | STITCH SETUP | COURSES | SECTION IN FIG. 2 |
|---|---|---|---|
| 1 | 37-39 | 1-22 | 250 |
| | 39 | 23-58 | 252 |
| | 39-37 | 59-88 | 254 |
| 2 | 37-39 | 1-32 | 244 |
| | 39 | 33-72 | 246 |
| | 39-37 | 73-116 | 248 |
| 3 | 37-39 | 1-32 | 238 |
| | 39 | 33-72 | 240 |
| | 39-37 | 73-126 | 242 |
| 4 | 37-39 | 1-32 | 232 |
| | 39 | 33-72 | 234 |
| | 39-37 | 73-116 | 235 |
| 5 | 37 | 1-56 | 208 |
| 6 | 37-39 | 1-32 | 220 |
| | 39 | 33-69 | 222 |
| | 39-37 | 65-100 | 224 |
| 7 | 37 | 1-20 | 206 |
| | 36-22 | 21-70 | 204 |
| 8 | 37 | 1-72 | 202 |

This specification in Table 1 can be used on a SFG knitting machine available from Shima Seiki Mfg., Ltd. based in Wakayama, Japan to create a size 9 glove. The information for the stitch setup and the number of courses are entered into the knitting machine's operation system using a keypad and LED display. Adjustments can be made to the specifications in Table 1 to create gloves of different sizes. The gloves can be knit from different compositions of yarn, including cotton, nylon fibers, water-soluble fibers, such as polyvinyl alcohol, or other fibers that can be used on a knitting machine, such as polyester or high-strength synthetic fibers, such as aramid, polyethylene, and liquid crystal polymer. The yarns used to knit the gloves can be spun yarns, textured filament yarns, or multi-component composite yarns.

Figure 3A:
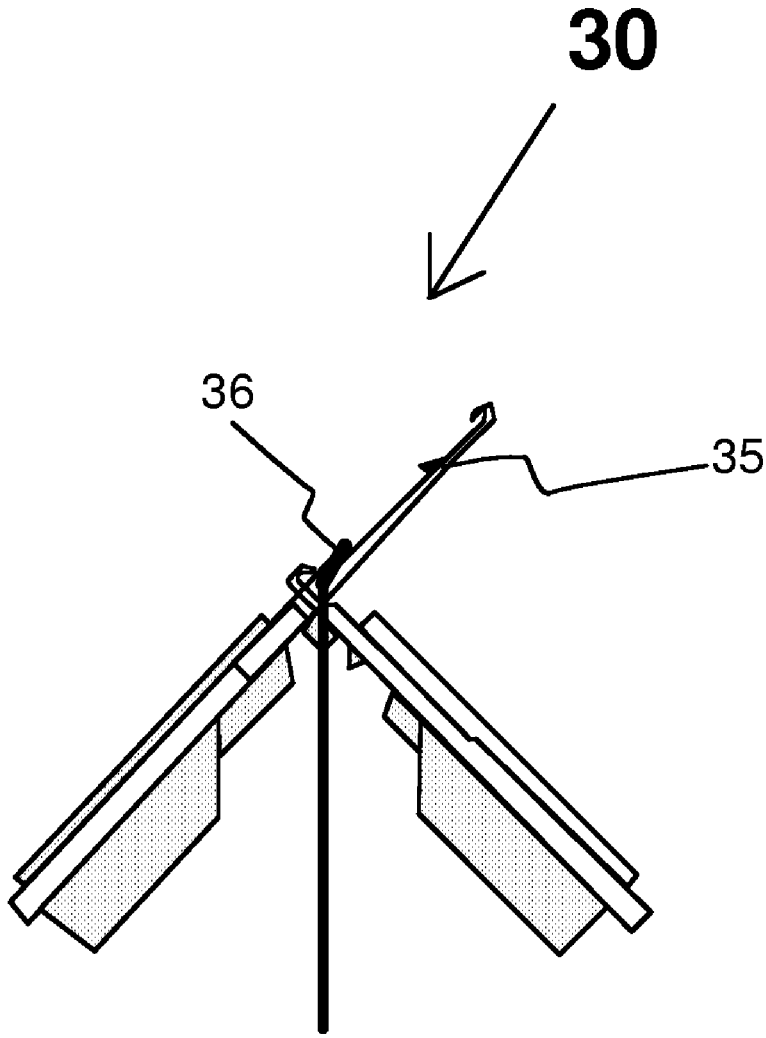
FIGS. 3*a* and 3*b* illustrate the first embodiment of varying stitch dimension using a stitch setup wherein the needle penetration determines the length of yarn included in the stitch.

FIG. 3*a* illustrates at 30 a stitch knitted with a smaller stitch setup number. The knitting needle 35 penetrates to a smaller extent, including a smaller loop of yarn 36 in the stitch, providing limited stretch capability.

Figure 3B:
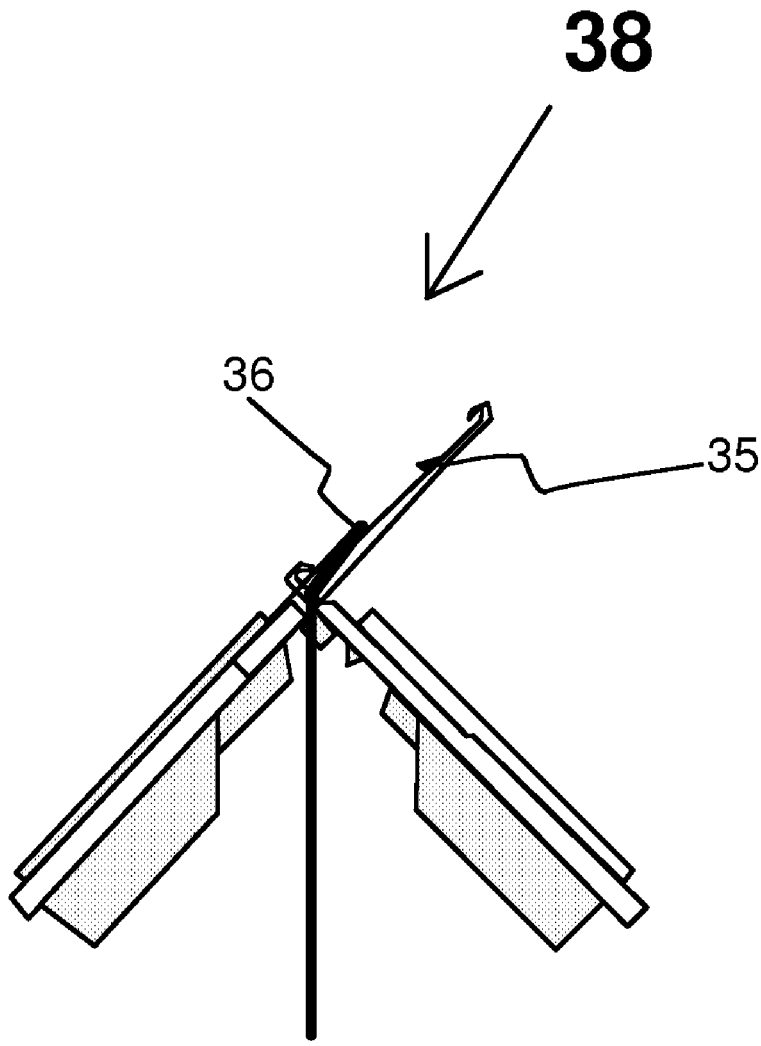

FIG. 3*b* illustrates at 38 a stitch knitted with a larger stitch setup number. The knitting needle 35 penetrates to a larger extent, including a larger loop of yarn 36 in the stitch, providing enhanced stretch capability.

Figure 4:
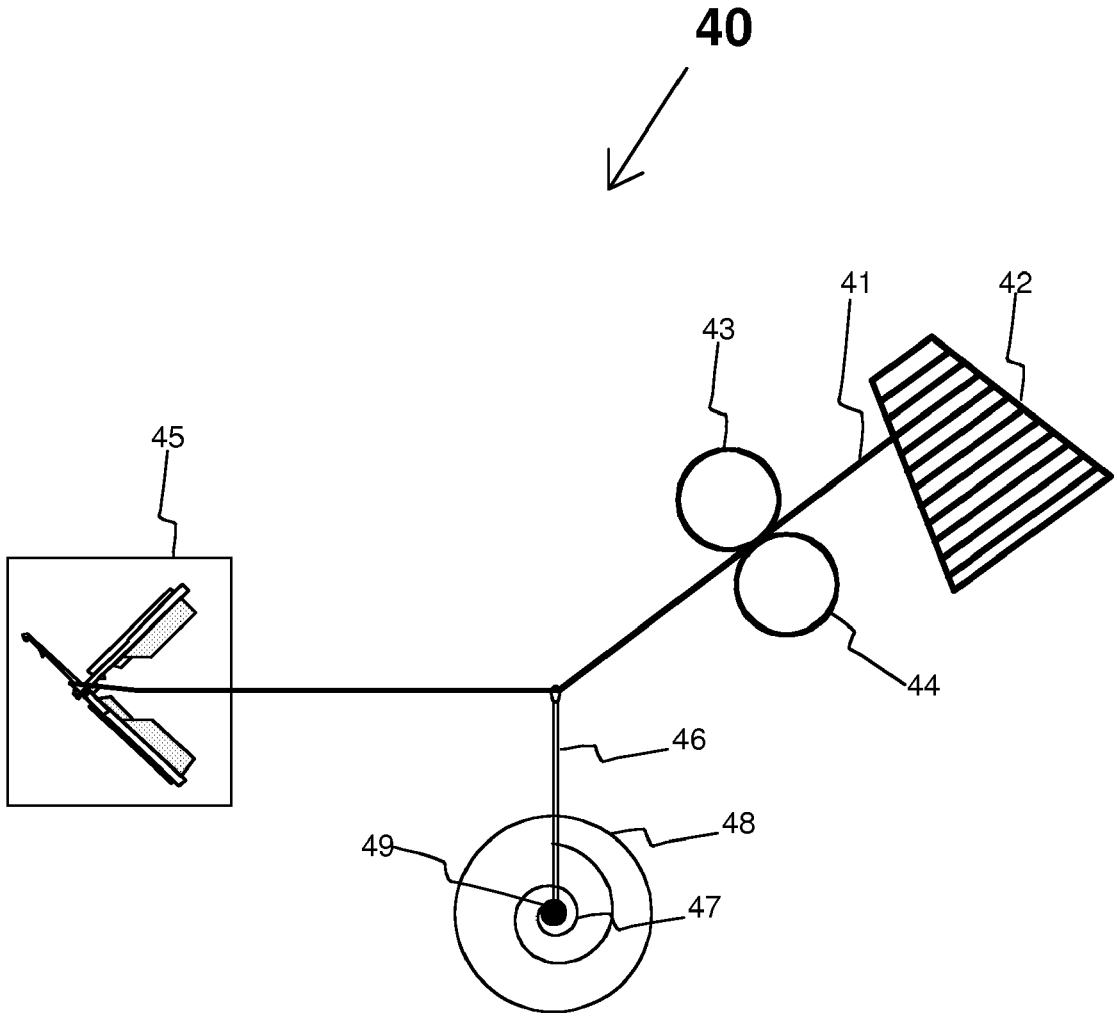
FIG. 4 shows the second embodiment of the stitch dimension wherein the computer controls the yarn feeding roller and the tension in the yarn between the pinch roller and the knitting head.

FIG. 4 illustrates at 40 a yarn 41 from a conical spool 42 fed through a pinch roller 43 and yarn feed roller 44. The yarn 41 is supplied to the knitting head 45 through a tension control device comprising a arm 46 attached to a spiral spring 47 which is connected to a computer controlled stepper motor 48. The rotation of the stepper motor shaft 49 increases the tension provided by the spiral spring 47, enhancing the tension in the yarn in the segment between the pinch roller 43 and knitting head 45. This variation in tension, generated under computer control, incorporates a higher level of tension within the stitch, limiting its stretch capability. The dimension of the stitch is independently controlled by the feed roller 44, which is also controlled by the computer.

The knitted variable stitch dimensions in the glove 200 allow the alteration of stitch dimension within a larger number of finger and palm sections than would be found in a standard glove 100. This increased number of sections benefits the glove by improving the degree to which it conforms to the shape of the hand, creating a better fit. In turn, this better fit provides increased dexterity and grip as well as increased long-term comfort in wearing the glove. In the present invention, stitch dimensions can be increased in areas such as knuckles, which would require greater glove flexibility as fingers move.

Knitted stitch dimensions can be used to eliminate additional manufacturing steps that would be required in, for example, the use of heat or water to shrink gloves or liners to fit a particular hand size. This saves both money and time in the manufacturing process and does not require unique times, temperatures, or pressures. It also produces a more consistent product than one relying on difficult-to-control steps, such as heat or tumbling.

A small study has been conducted to compare glove flexibility and resulting hand dexterity of standard shaped gloves as compared to gloves of this invention. Subjects in the study assembled eight sets of five different nut and screw sizes, while wearing the standard glove and while wearing the knitted variable stitch glove of this invention. Each subject in the study showed a decrease in the time it took to assemble the set of nuts and screws when wearing the gloves of this invention. In the study, decreases in time ranged from 13.9% to 20.3%. This study shows that the glove of this invention improved the fit of the knitted gloves, such that it increased dexterity and grip over the standard glove.

The knitted gloves of this invention, once finished, also can be coated either on the outside or inside with a coating, such as natural rubber latex or synthetic rubber latex, as well as other elastomeric polymer coatings. The coating can be applied by dipping the knitted glove of this invention into the coating material or by spraying the coating onto the glove. Coating the knitted gloves of this invention can improve the grip of the glove in handling dry and oily items when the coating is on the outside of the glove. The addition of a coating to the knitted layer can also improve the quality of the glove as an insulator.

Although only a few exemplary embodiments of the present invention have been described in detail above, those skilled in the art will readily appreciate that many modifications are possible in the exemplary embodiments without materially departing from the novel teachings and advantages of this invention. For example, the number of sections of the glove can be increased or decreased to adjust the fit of the glove without departing from the spirit of the present invention. Accordingly, all such modifications are intended to be included within the scope of this invention as defined in the following claims.

The use of the terms "a," "an," "the," and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to illuminate better the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A method of making a knitted glove, the method comprising the steps of:

knitting at least two sections of a plurality of finger components;

knitting at least two sections of a thumb component;

knitting at least two sections of a palm component; and knitting at least one section of a wrist component;

wherein the step of knitting one section of one of the components comprises casting a plurality of stitches to form a course; combining a plurality of courses to form the section; and varying the stitch dimension of at least three stitches in at least one course or in at least one section from a first dimension to a second dimension to a third dimension, thereby providing a glove having an overall shape that accommodates variations in size and shape of individual fingers and hands.

2. The method of claim 1, wherein the step of varying the stitch dimension further comprises using a programmable computer associated with a knitting machine.

3. The method of claim 2, wherein the step of using the programmable computer comprises controlling a depth of a knitting needle to vary the stitch dimension of the at least one stitch.

4. The method of claim 2, wherein the step of using the programmable computer comprises controlling a tension of the yarn between a knitting head and a pinch roller to vary the stitch dimension of the at least one stitch.

5. The method of claim 4, wherein the step of controlling the tension includes adjusting a stepper motor connected to a spiral spring.

6. The method of claim 4, wherein the step of using the programmable computer further includes driving a feed roller.

7. The method of claim 2, wherein the step of varying the stitch dimension includes casting off one or more stitches or picking up additional stitches in the at least one course according to a desired shape of a glove section.

8. The method of claim 1, wherein the step of varying stitch dimensions further comprises varying the stitch dimensions from the third dimension through the second dimension and back to the first dimension.

9. The method of claim 1, wherein the step of varying stitch dimensions comprises varying the stitch dimension linearly from the first dimension through the second dimension to the third dimension.

10. A knitted glove comprising:

(i) a plurality of finger components, each comprising at least two separate knitted sections;

(ii) a thumb component comprising at least two separate knitted sections;

(iii) a palm component comprising at least two separate knitted sections; and (iv) a wrist component comprising at least one knitted section;

wherein one of the knitted sections comprises three different stitch dimensions.

11. The knitted glove of claim 10, wherein the glove is knitted from a yarn comprising a high-strength synthetic fiber.

12. The knitted glove of claim 11, wherein the synthetic fiber comprises an aramid, a polyethylene, a liquid crystal polymer, or combinations thereof.

13. The knitted glove of claim 10, wherein the knitted glove is coated with an elastomeric polymer material.

14. The knitted glove of claim 13, wherein the elastomeric polymer material is selected from the group consisting of natural rubber latex and synthetic rubber latex.

15. The knitted glove of claim 10, wherein each of the plurality of finger components comprises three separate knitted sections and at least two of the knitted sections each comprise three different stitch dimensions.

16. The knitted glove of claim 10, wherein the palm component comprises three separate knitted sections and at least one of the knitted sections comprises three different stitch dimensions.

17. The knitted glove of claim 10, wherein the thumb component comprises three separate knitted sections and at least two of the knitted sections each comprise three different stitch dimensions.

* * * * *